US009246263B2

(12) United States Patent
Jauch

(10) Patent No.: US 9,246,263 B2
(45) Date of Patent: Jan. 26, 2016

(54) POWER PLUG CLAMPING DEVICE

(71) Applicant: John Andrew Jauch, Waxhaw, NC (US)

(72) Inventor: John Andrew Jauch, Waxhaw, NC (US)

( * ) Notice: Subject to any disclaimer, the term of this patent is extended or adjusted under 35 U.S.C. 154(b) by 117 days.

(21) Appl. No.: 14/087,778

(22) Filed: Nov. 22, 2013

(65) Prior Publication Data

US 2015/0147908 A1 May 28, 2015

(51) Int. Cl.
*H01R 13/639* (2006.01)
*H01R 13/621* (2006.01)
*B61G 5/10* (2006.01)

(52) U.S. Cl.
CPC ..... *H01R 13/6215* (2013.01); *H01R 13/6395* (2013.01)

(58) Field of Classification Search
CPC .. H01R 13/73; H01R 25/006; H01R 13/6395; H01R 13/639; H01R 13/6392; B61G 5/10
USPC ..... 439/574, 345, 343, 299, 373; 213/1.3, 213/1.6; 174/53–64, 67; 29/278, 270, 261, 29/265, 428, 466
See application file for complete search history.

(56) References Cited

U.S. PATENT DOCUMENTS

| | | | | |
|---|---|---|---|---|
| 5,383,796 | A * | 1/1995 | Bowen | H01R 13/595 439/469 |
| 5,472,355 | A * | 12/1995 | Wittmann | 439/373 |
| 6,966,792 | B1 * | 11/2005 | Willers et al. | 439/373 |
| 7,101,215 | B2 * | 9/2006 | Woellner et al. | 439/371 |
| 7,112,086 | B1 * | 9/2006 | Wu | H01R 13/5812 439/458 |
| 7,140,903 | B2 * | 11/2006 | Pulizzi et al. | 439/371 |
| 7,857,654 | B2 * | 12/2010 | West et al. | 439/373 |
| 8,540,093 | B2 * | 9/2013 | Paral | 213/1.3 |
| 2007/0258758 | A1 * | 11/2007 | Ho | 403/398 |
| 2008/0076291 | A1 * | 3/2008 | Ewing et al. | 439/373 |

* cited by examiner

*Primary Examiner* — Amy Cohen Johnson
*Assistant Examiner* — Matthew T Dzierzynski
(74) *Attorney, Agent, or Firm* — Shumaker, Loop & Kendrick, LLP

(57) ABSTRACT

A clamp for securing a power plug in a socket including a pair of identical clamping plates separate from each other that are drawn together to capture the socket therebetween and secure the power plug engaged in the socket, each of the clamping plates including a plate having spaced posts and a plug retaining member extending therefrom, the plug retaining member defining an arcuate portion arranged such that the arcuate portions of the plug retaining members oppose one another in use to radially compress the power plug therebetween.

17 Claims, 5 Drawing Sheets

POWER PLUG CLAMPING DEVICE

TECHNICAL FIELD AND BACKGROUND OF THE INVENTION

The present invention, relates generally to a system for retaining an electrical plug in a socket, and more particularly, to a clamp including a pair of identical clamping plates configured to be drawn toward each other to capture a electrical socket therebetween and radially compress an electrical plug engaged in the socket to prevent the plug from being pulled from the socket unintentionally.

The connector attached to the end of the main power cable of an electrically operated device is commonly referred to as a "plug," and the receptacle for receiving the plug to connect the plug to an energized electrical circuit is commonly referred to as a "socket." Plugs typically include protruding pins that fit into matching slots in receptacles to prevent exposure of bare energized contacts. The pins typically protrude from an insulating body that conceals the electrical connections between the pins and the wires of the power cable, as well as provides strain relief from pulling forces on the cable.

In conventional plug and sockets designs, there is no integrated structure to prevent the plug from being pulled from the socket. Engagement is typically ensured by an interference fit between the pins and the contacts within the slots, which is easily overcome upon light pulling forces on the cable. While unintentionally pulling a plug from a socket may not be problematic to some electronic devices, it can be catastrophic to sensitive electronics and electronic devices requiring an uninterruptible power supply, such as computer equipment in a data room.

BRIEF SUMMARY OF THE INVENTION

In a first embodiment, a clamp for securing a plug of generally circular cross-section in an electrical socket is provided herein and includes a pair of clamping plates separate from each other, each clamping plate having a pair of spaced posts and a plug retaining member defining an arcuate portion, the posts spaced from the plug retaining member such that the electrical socket can be positioned therebetween, each of the posts and the plug retaining member defining a through hole such that fasteners passing through the through holes are tightened to draw the clamping plates toward each other to secure the plug between the arcuate portions of the plug retaining members.

In a further embodiment, the posts may be positioned at one end of the plate and may extend perpendicularly from the plate.

In a further embodiment, the plug retaining member may be positioned at the other end of the plate, and the arcuate portion of the plug retaining member may be arranged axially perpendicular to the through hole through the plug retaining member.

In a further embodiment, the arcuate portion of the plug retaining member may be positioned between spaced through holes in the plug retaining member.

In a further embodiment, the arcuate portion of the plug retaining member may include inwardly projecting ribs.

In a further embodiment, the inwardly projecting ribs may be laterally bisected by a recess formed in the plug retaining member.

In a further embodiment, the posts, plug retaining member, and plate may be integrally formed.

In a further embodiment, the pair of clamping plates may be arranged to capture the electrical socket therebetween such that the electrical socket is exposed through an opening formed between the arcuate portions of the plug retaining members.

In a further embodiment, a recess may be defined along an edge of the plate between the posts.

In a further embodiment, the posts may be positioned along one edge of the plate and the plug retaining member may be positioned along an opposing edge of the plate and may extend the length thereof.

In a further embodiment, each clamping plate may include a removable insert tethered to the plug retaining member for engaging within the arcuate portion to reduce the inner diameter thereof.

In another embodiment, provided herein is a clamp, made in two identical half sections, for being secured around an electrical box to retain a power plug in a socket, the half sections each including a plate having spaced posts and a plug retaining member extending therefrom, the plug retaining member defining an arcuate portion, the posts spaced from the plug retaining member to position the electrical box therebetween, each of the posts and the plug retaining member defining a through hole such that fasteners passing through the through holes are tightened to draw the half sections toward each other to radially compress the plug between the arcuate portions of the plug retaining members.

In a further embodiment, the posts may be positioned along a first edge of the plate, the plug retaining member may be positioned along a second, opposing edge of the plate, and the arcuate portion of the plug retaining member may be arranged axially perpendicular to the through hole through the plug retaining member.

In a further embodiment, the arcuate portion of the plug retaining member may be positioned between spaced through holes in the plug retaining member.

In a further embodiment, the arcuate portion of the plug retaining member may include inwardly projecting ribs.

In a further embodiment, the half sections may be arranged to capture the electrical box therebetween such that the socket is exposed through an opening formed between the arcuate portions of the plug retaining members.

In yet another embodiment, a clamp for securing a power plug in a socket is provided herein, the clamp including a pair of identical clamping plates separate from each other that are drawn together to capture the socket therebetween and secure the power plug engaged in the socket, each of the clamping plates including a plate having spaced posts and a plug retaining member extending therefrom, the plug retaining member defining an arcuate portion arranged such that the arcuate portions of the plug retaining members oppose one another in use to radially compress the power plug therebetween as the clamping plates are drawn together.

In a further embodiment, each post of the clamping plates may define an axial passage therethrough, wherein the axial passages of the posts of the opposing clamping plates align to receive a fastener therethrough for drawing the clamping plates toward each other.

In a further embodiment, the plug retaining member of each clamping plate may have a through hole for receiving a fastener, wherein the through holes of the opposing clamping plates are aligned and the fastener is received therethrough to draw the clamping plates toward each other.

Embodiments of the invention can include one or more or any combination of the above features and configurations.

Additional features, aspects and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION OF THE INVENTION

Figure 1:
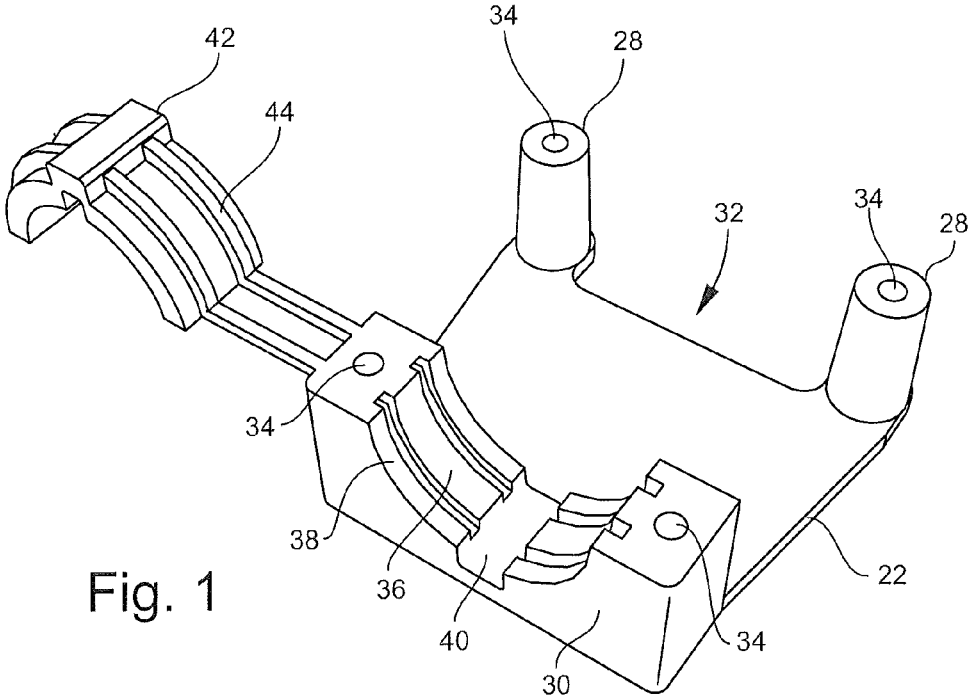
FIG. 1 is a perspective view of a clamping plate according to an embodiment of the invention.

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

Referring to the figures, a power plug retaining assembly, also referred to herein as a "clamp," is disclosed for securing a power plug engaged in an electrical socket to prevent the power plug from being pulled from the socket unintentionally. The term "power plug" is used synonymously herein with the word "plug," and is intended to encompass any type and form of plug housing attached to the end of a power cable and having pins or prongs protruding from the end thereof. As shown throughout the drawings, the plug has a generally circular cross-section and therefore the clamp has complementary arcuate surfaces for tight fit engagement therebetween. It is envisioned that the plug may have a different cross-section such as rectangular, and the clamp engagement surface may be modified accordingly to complement such a cross-section. The terms "electrical socket," "socket," "electrical box," and "receptacle" are used synonymously herein and are intended to encompass an electrical socket and its exposed housing, wherein the term "exposed" is intended to mean accessible such that the clamp can be installed around to capture the socket between the clamp halves.

The clamp for securing the power plug in the socket is shown generally throughout the figures at reference numeral 20. The clamp 20, made in two identical half sections, generally includes a pair of identical clamping plates 22 separate from each other that are drawn together using fasteners 24 to secure the clamping plates together, capture the socket therebetween, and secure the power plug in an engaged state in the socket.

The clamping plates 22 each include a plate 26 having spaced posts 28 and a plug retaining member 30 extending from a common face of the plate. The posts 28 are positioned proximate the corners of the plate 26 along one edge of the plate, and extend generally perpendicular from the face of the plate. A recess 32 may be formed along the edge of the plate 26 between the posts 28 for receiving a portion of track therein to which the socket is attached and supported, as described in detail below. Each post 28 defines an axial passage or "through hole" 34 therethrough for receiving the fasteners 24. Although shown with a slight cylindrical taper in the figures, the cross-section of the posts 28 is not critical to the design of the clamp 20, and therefore is not intended to be limiting. The posts 28 may have other cross-sections, for example, square, rectangular, cylindrical, etc. The through hole 34 is preferably arranged axially perpendicular to the plane on the plate 26 such that opposing post through holes align to form a continuous linear passage for the fasteners 24 when the opposing clamping plates 22 are aligned.

The plug retaining member 30 extends perpendicularly from the face of the plate and defines an arcuate portion 36 at a distal end thereof for engaging with the plug. The plug retaining member 30 is positioned at the opposite end of the plate from the spaced posts 28 such that the socket housing can be positioned therebetween. The plug retaining member 30 as shown extends the length of the opposing end of the plate 26. The plug retaining member defines spaced through holes 34 therethrough axially parallel to the through holes 34 through the posts 28. Thus, each clamping plate 22 includes a through hole 34 positioned at each corner thereof for securing the clamping plates together.

The arcuate portion 36 of the plug retaining member 30 is arranged axially perpendicular to the through holes 34 through the plug retaining member. The arcuate portion 36 includes inwardly extending ribs 38 for engaging the plug to radially compress the plug between the arcuate portions of the opposing clamping plates 22. The ribs 38 may be laterally bisected by a recess 40 defined in the arcuate portion.

Figure 2:
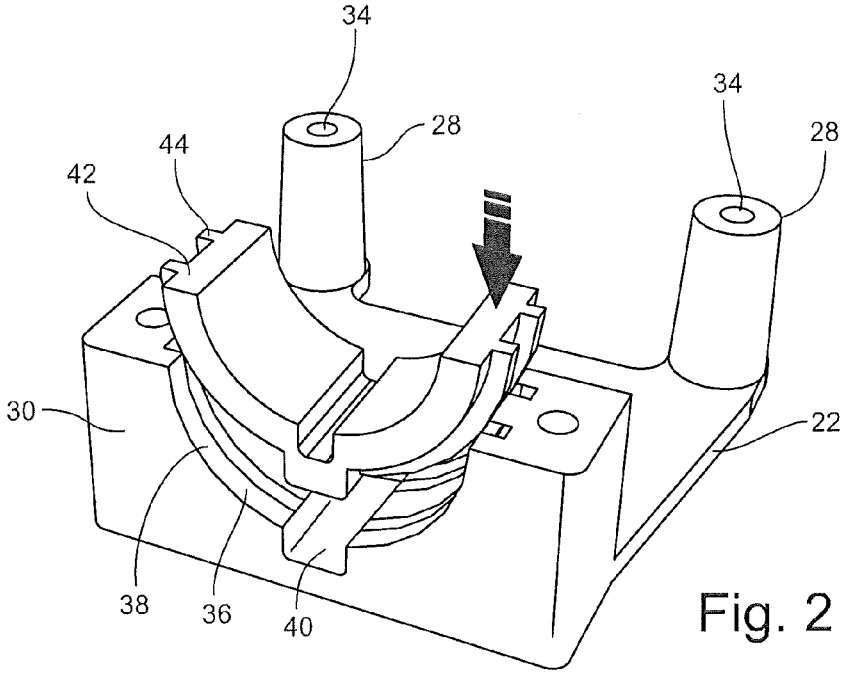
FIG. 2 is a perspective view of the clamping plate of FIG. 1 showing installation of a removable insert.
Figure 3:
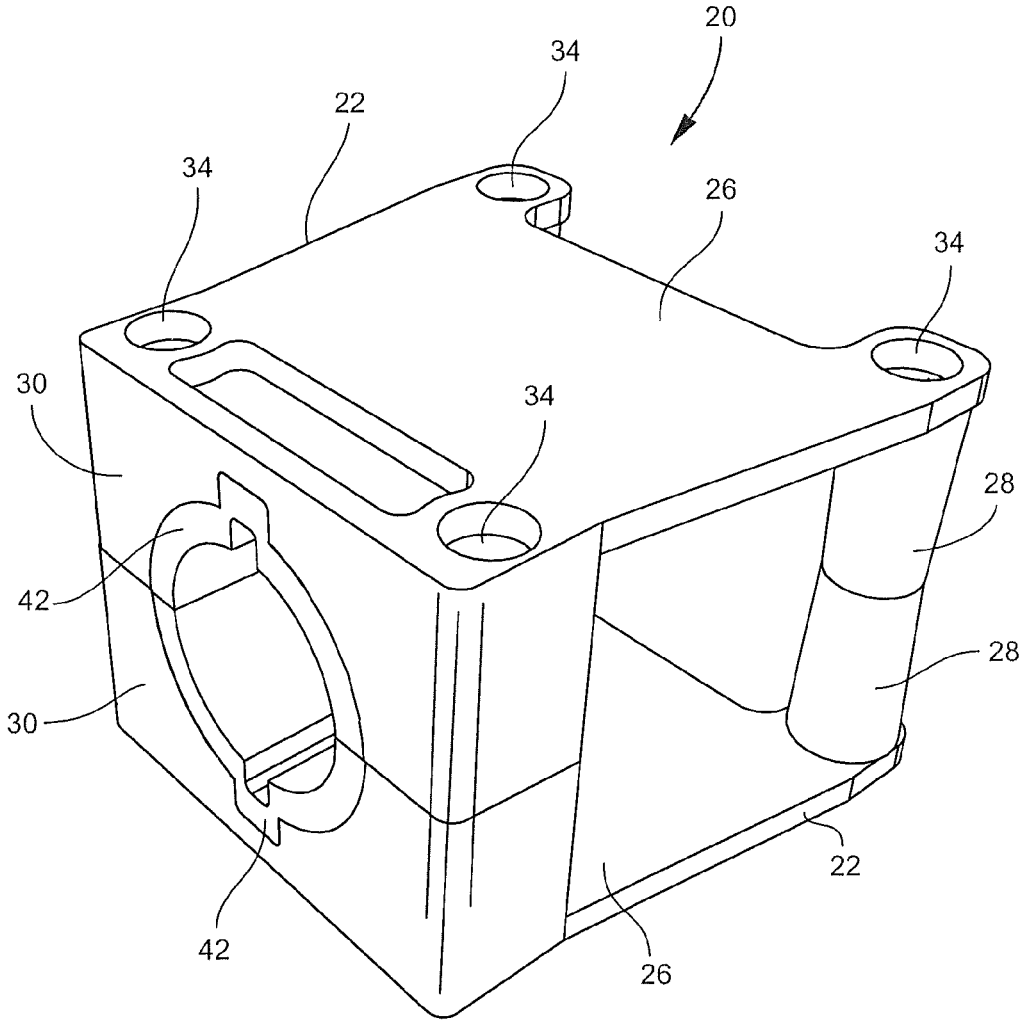
FIG. 3 is a perspective view showing two identical clamping plates arranged to form a clamp.

The arcuate portions 36 of the opposed clamping plates 22 together define a circular opening for radially compressing the plug to capture the plug therebetween. Because plug diameters may vary, a removable insert 42 may be attached to the clamping plate 22 to allow the clamp 20 to accommodate the different plug diameters. The insert 42 is detachable from the clamping plate by being cut therefrom, and is shaped to engage within the arcuate portion 36 to reduce the diameter thereof to accommodate smaller plug diameters. As shown, the insert 42 includes outwardly extending ribs 44 that fit within the spaces between the inwardly extending ribs 38 of the plug retaining member 30 to secure the insert in the arcuate portion 36 to prevent axial movement therebetween, as best shown in FIG. 2.

The plate 26, posts 28 and plug retaining member 30 may be integrally formed. Suitable examples of materials for constructing the clamping plates 22 include, but are not limited to, plastics and thermoplastic resins such as polyethylene, high-density polyethylene, polystyrene, etc.

Figure 4:
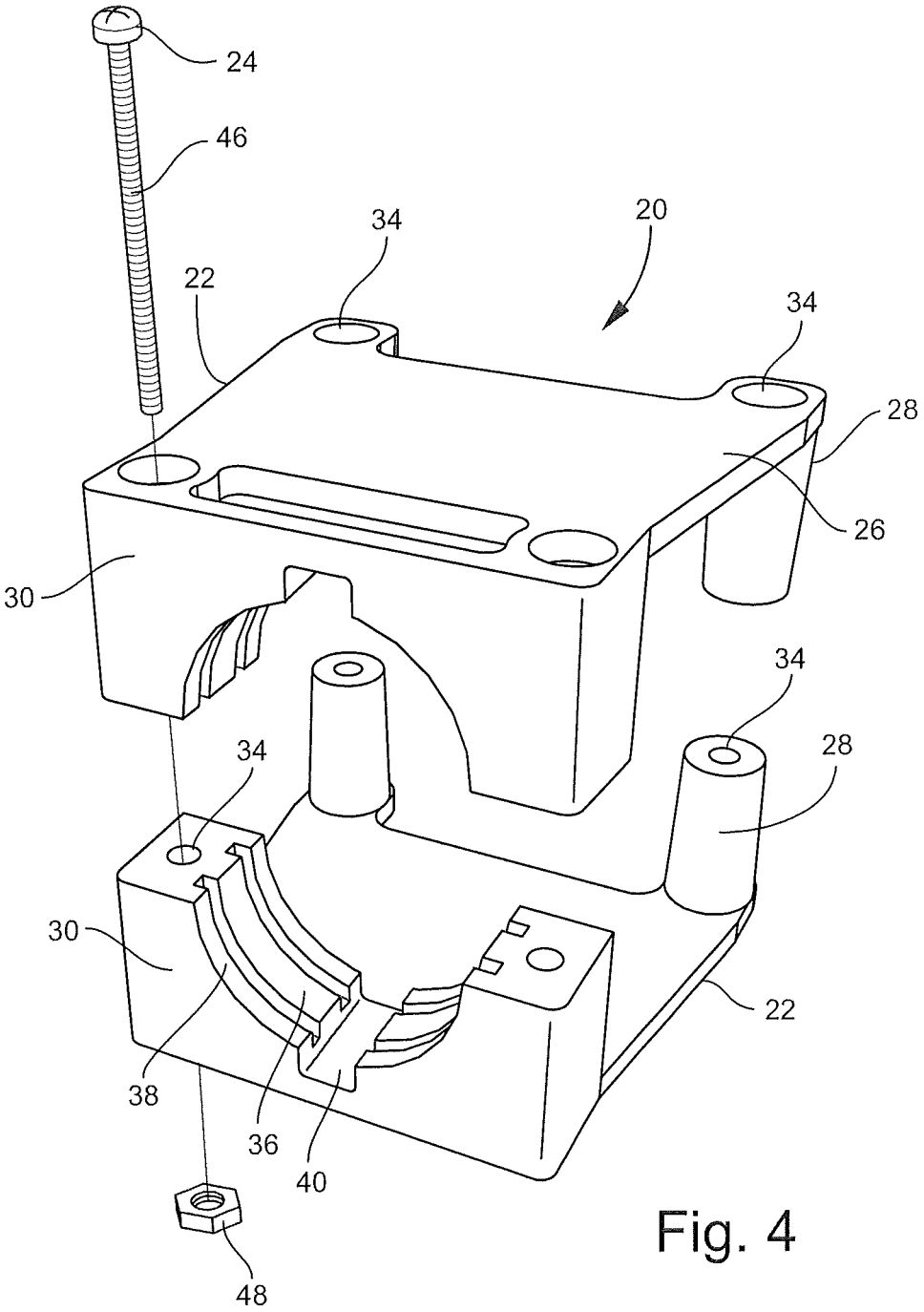
FIG. 4 is an exploded view of the clamp of FIG. 3 showing a fastener for drawing the clamping plates toward each other.

Referring to FIG. 4, the clamp 20 is formed by placing the identical clamping plates 22 in an opposing, mirror image relationship such that the posts 28, plug retaining members 30, and axial passages 34 therethrough are aligned, and the arcuate portions 36 of the plug retaining members 30 cooperatively form the circular opening. FIG. 4 shows an exemplary fastener 24 including a bolt 46 and a nut 48, wherein the nut is inserted into a complementary-shaped (e.g., hexagonal) recess in the clamping plate 22, and the threaded bolt is advanced through the nut to draw the opposing clamping plates toward each other. The clamping plates 22 may define a recess for receiving the head of the bolt 46 such that the head of the bolt is recessed from the face of the clamping plate. Depending on the size of the socket housing and the plug diameter, the clamping plates 22 may be drawn toward each other such that the plates touch or there is a space therebetween.

Figure 5:
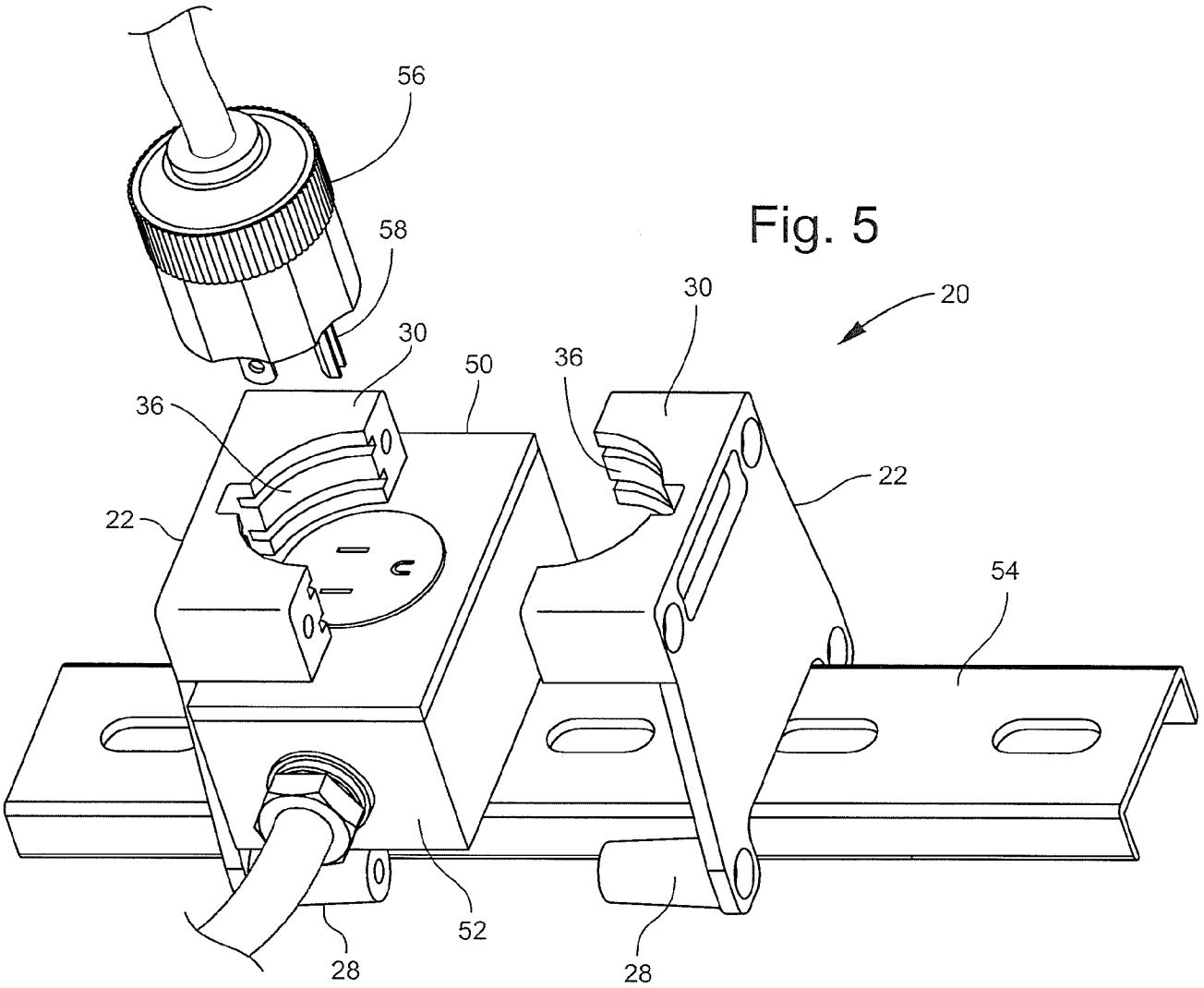
FIG. 5 shows the clamp of FIG. 3 partially installed around an electrical socket.
Figure 6:
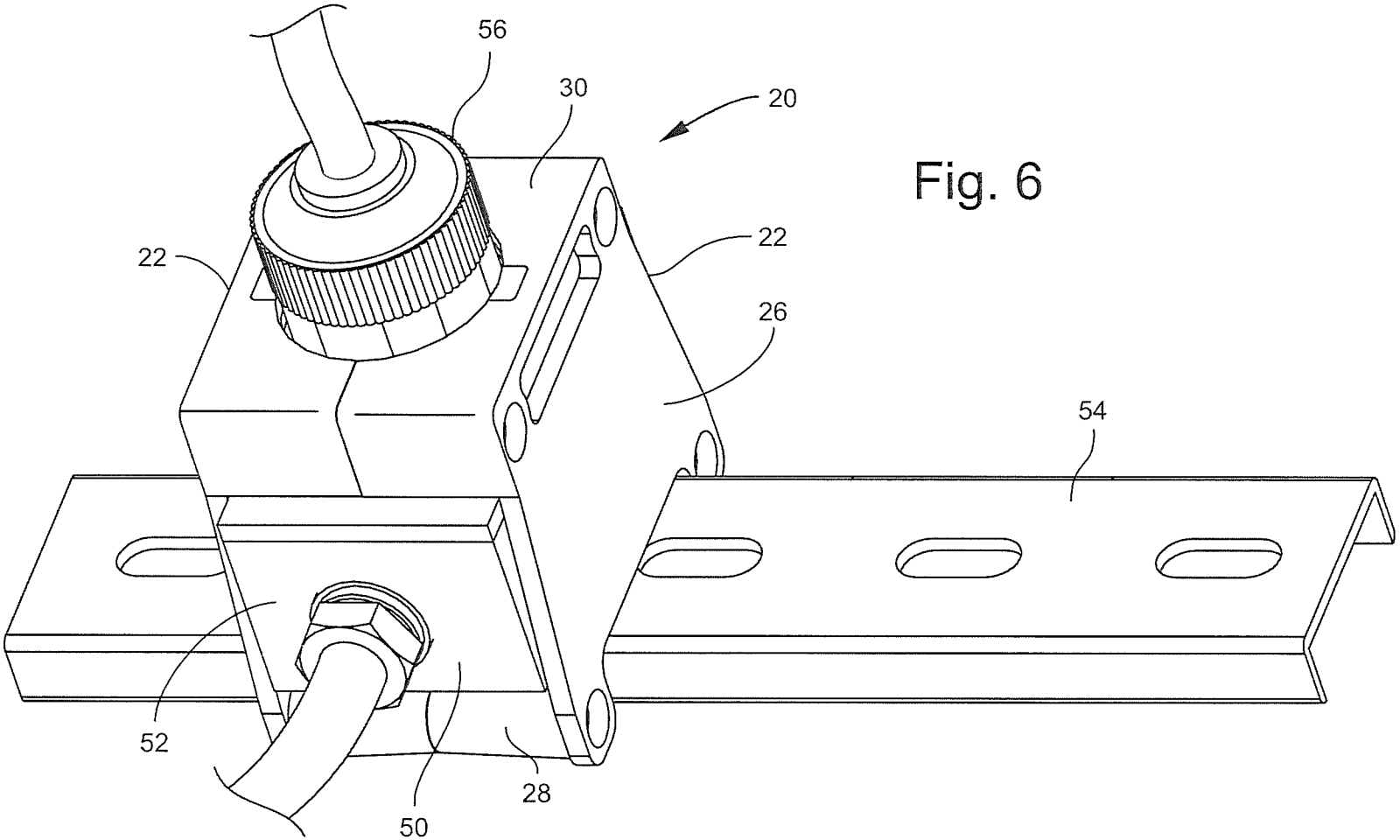
FIG. 6 shows the clamp fully installed around an electrical socket to secure a power plug in the socket.

Referring to FIGS. 5 and 6, the clamp 20 is shown partially installed around an electrical socket 50. The electrical socket 50 shown is an example of the type commonly found in a data room, wherein the socket includes a metal housing 52 attached to a section of metal track 54 arranged horizontally. Without the clamp 20 of the present invention, the plug 56 is held in the socket 50 only by way of the interference fit between the pins 58 and the contacts within the plug. With the plug 56 engaged in the socket, to secure the plug 56 in the socket 50, the first clamping plate 22 is installed such that the plate 26 is mounted against a side of the socket with the posts 28 behind the socket, the track 58 in the recess 32, and the plug retaining member 30 covering a portion of the front face of the socket such that the socket slots are left exposed. The second clamping plate 22 is installed from the other side of the socket 50 and in the same manner as the first clamping plate, such that the features of the clamping plates oppose one another and the through holes 34 are aligned to receive the fasteners.

FIG. 6 shows the clamp 20 fully installed with the socket housing captured or "caged" between the features of the clamping plates 22. In this arrangement, the posts 28 positioned behind the socket 50 prevent the clamp 20 from being pulled in the direction of the plug 56, and the positioning of the track 54 in the recess 32 between the posts 28 prevents the clamp from moving laterally. The clamp 20 is tightened such that the clamping plates 22 radially compress the plug 56 to resist axially pulling forces on the plug, thereby preventing the plug from being pulled from the receptacle. The plug 56 is released from capture between the clamping plates 22 by loosening the fasteners 24 enough so that the plug can be unplugged, thus it is not necessary to remove the clamp 20 entirely in order to plug in or unplug the plug.

The foregoing description provides embodiments of the invention by way of example only. It is envisioned that other embodiments may perform similar functions and/or achieve similar results. Any and all such equivalent embodiments and examples are within the scope of the present invention and are intended to be covered by the appended claims.

What is claimed is:

1. A clamp for securing a plug of generally circular cross-section in an electrical socket, the clamp comprising a pair of clamping plates separate from each other, each clamping plate having a pair of spaced posts and a plug retaining member defining an arcuate portion, the spaced posts and the plug retaining member extending perpendicularly from a common face of the clamping plate, the posts spaced from the plug retaining member such that a housing of the electrical socket can be positioned therebetween and between planar faces of the clamping plates, each of the posts and the plug retaining member defining a through hole such that fasteners passing through the through holes are tightened to draw the clamping plates toward each other to radially compress the plug between the arcuate portions of the plug retaining members and capture the housing of the electrical socket between the clamping plates such that the spaced posts are positioned behind the housing, the plug retaining members are positioned forward of the housing, and the planar faces of the clamping plates are positioned adjacent opposing sides of the housing.

2. The clamp of claim 1, wherein the posts are positioned at a first end of the plate and extend perpendicularly from the plate.

3. The clamp of claim 1, wherein the plug retaining member is positioned at a second end of the plate, and wherein the arcuate portion of the plug retaining member is axially perpendicular to the through hole through the plug retaining member.

4. The clamp of claim 1, wherein the arcuate portion of the plug retaining member is positioned between spaced through holes in the plug retaining member.

5. The clamp of claim 1, wherein the arcuate portion of the plug retaining member comprises inwardly projecting ribs.

6. The clamp of claim 5, wherein the inwardly projecting ribs are laterally bisected by a recess formed in the plug retaining member.

7. The clamp of claim 1, wherein the posts, the plug retaining member, and the plate are integrally formed.

8. The clamp of claim 1, wherein the pair of clamping plates are arranged to capture the electrical socket therebetween such that the electrical socket is exposed through an opening formed between the arcuate portions of the plug retaining members.

9. The clamp of claim 1, wherein a recess is defined along an edge of the plate between the posts.

10. The clamp of claim 1, wherein the posts are positioned along one edge of the plate and the plug retaining member is positioned along an opposing edge of the plate and extends the length thereof.

11. The clamp of claim 1, further comprising a removable insert tethered to the plug retaining member for engaging within the arcuate portion to reduce the inner diameter thereof.

12. A clamp, made in two identical half sections, for being secured around an electrical box to retain a power plug in an electrical socket of the electrical box, the half sections each comprising a plate having spaced posts and a plug retaining member extending perpendicularly from a common face of the plate, the plug retaining member defining an arcuate portion, the posts spaced from the plug retaining member to position the electrical box therebetween, each of the posts and the plug retaining member defining a through hole such that fasteners passing through the through holes are tightened to draw the half sections toward each other to compress the plug between the arcuate portions of the plug retaining members and capture the electrical box between the clamping plates such that the spaced posts are positioned behind the electrical box, the plug retaining members are positioned forward of the electrical box, and planar faces of the plates are positioned adjacent opposing sides of the electrical box.

13. The clamp of claim 12, wherein the posts are positioned along a first edge of the plate, the plug retaining member is positioned along a second, opposing edge of the plate, and the arcuate portion of the plug retaining member is axially perpendicular to the through hole through the plug retaining member.

14. The clamp of claim 12, wherein the arcuate portion of the plug retaining member is positioned between spaced through holes in the plug retaining member.

15. The clamp of claim 12, wherein the arcuate portion of the plug retaining member comprises inwardly projecting ribs.

16. The clamp of claim 12, wherein the posts, the plug retaining member, and the plate of each half section are integrally formed.

17. The clamp of claim 12, wherein the half sections are arranged to capture the electrical box therebetween such that the socket is exposed through an opening formed between the arcuate portions of the plug retaining members.

* * * * *